US005775950A

United States Patent [19]

Tsuji

[11] Patent Number: 5,775,950

[45] Date of Patent: Jul. 7, 1998

[54] CARD-EDGE CONNECTOR

[75] Inventor: Takeshi Tsuji, Yokkaichi, Japan

[73] Assignee: Sumitomo Wiring Systems, Ltd., Japan

[21] Appl. No.: 714,391

[22] Filed: Sep. 16, 1996

[30] Foreign Application Priority Data

Sep. 22, 1995 [JP] Japan ..... 7-269228

[51] Int. Cl.[6] ..... H01R 23/70

[52] U.S. Cl. ..... 439/637; 439/852

[58] Field of Search ..... 439/637, 636, 439/862, 747, 852

[56] References Cited

U.S. PATENT DOCUMENTS

| | | | |
|---|---|---|---|
| 3,530,422 | 9/1970 | Goodman | 439/637 |
| 4,017,143 | 4/1977 | Knowles | 439/637 |
| 4,431,252 | 2/1984 | Cairns et al. | 439/862 |
| 5,090,925 | 2/1992 | Sato et al. | 439/862 |

FOREIGN PATENT DOCUMENTS

| | | |
|---|---|---|
| 5-217642 | 8/1993 | Japan . |
| 6-52940 | 2/1994 | Japan . |
| 6-17170 | 3/1994 | Japan . |
| 6-89762 | 3/1994 | Japan . |
| 6-104057 | 4/1994 | Japan . |
| 6-111878 | 4/1994 | Japan . |
| 6-118871 | 4/1994 | Japan . |
| 6-54275 | 7/1994 | Japan . |
| 6-302361 | 10/1994 | Japan . |
| 7-142128 | 6/1995 | Japan . |
| 7-29776 | 6/1995 | Japan . |

OTHER PUBLICATIONS

Abstract of Japanese 7–142128, 060/2/95.
Abstract of Japanese 6–111878, Apr. 22, 1994.
Abstract of Japanese 6–302361, Oct. 28, 1994.
Abstract of Japanese 6–111871, Apr. 22, 1994.
Abstract of Japanese 6–104057, Apr. 15, 1994.
Abstract of Japanese 6–89762, Mar. 29, 1994.
Abstract of Japanese 6–52940, Feb. 25, 1994.
Abstract of Japanese 5–217642, Aug. 27, 1993.
Abstract of Japanese 7–29776, Jun. 02, 1995.
Abstract of Japanese 6–17170, Mar. 04, 1994.

*Primary Examiner*—Gary F. Paumen
*Assistant Examiner*—T. C. Patel
*Attorney, Agent, or Firm*—Banner & Witcoff, Ltd.

[57] ABSTRACT

Side walls 15 are provided on a contact terminal 12 to enclose the root of a resilient contact 14, and a stopper 16 is provided to prevent excessive bending of the contact 14. The sidewalls 15 also prevent entanglement of the terminals in a parts feeder. In a connector housing 11, controlling walls 21 are formed at an exit mouth 18c of a terminal insertion chamber 18 to support a resilient contact 14 against sideways bending. The chamber has opposed internal walls 18e to retain the terminal.

12 Claims, 3 Drawing Sheets

CARD-EDGE CONNECTOR

TECHNICAL FIELD

The present invention relates to an electrical card-edge connector, and to a terminal for such a connector.

BACKGROUND TO THE INVENTION

As shown in FIG. 8 of the appended drawings, a card-edge connector generally has an insertion slot 1 formed on an upper face of a connector housing 7, and adapted to receive one edge of a plate 2 arranged to be insertable into the slot 1. A plurality of terminal insertion chambers 3 are formed facing each other in a length-wise direction at regular intervals on the inner wall faces of slot 1, each chamber 3 having a terminal 5 with a resilient contact 4. The terminal 5 is inserted so that the contact 4 projects towards the middle of the slot 1. The terminal 5 is formed by folding over a thin metal plate, and the resilient contact 4 is formed by the free end-portion thereof.

The extreme edge of the plate 2 has a plurality of electrically conducting members 6 equidistant with respect to each other on both side faces. When the edge of the plate 2 is inserted into the slot 1, each corresponding conducting member 6 and contact terminal 5 makes pressure contact.

However, since the terminal has a configuration whereby it is merely folded over so as to form a resilient contact, there is a possibility that terminals will make contact with each other during transportation on a parts feeder and become entangled; this can result in a change of shape.

In order to prevent entanglement, one solution is to form side walls in an integral manner so as to enclose the base portion of the contact. However, if such a configuration is adopted, a space forms between the contact and the side wall. This may allow the contact to bend in use in a direction other than the correct one. Specifically, when the plate is pressed in and removed, a change in shape of the contact due to forces from the edge of the base plate or the like becomes possible.

The present invention has been developed after taking into account the above problem and aims at providing a terminal and a card-edge connector which are less susceptible to an undesirable change of shape of the contact terminal.

SUMMARY OF THE INVENTION

According to a first aspect the invention provides a card-edge connector comprising a housing having a slot to receive a card-edge, the housing having a recess at the side of said slot and said recess having an electrical terminal therein, the terminal comprising a body within said recess and a resilient member protruding into said slot through an opening for contact with a card-edge, wherein said recess includes a plurality of abutment surfaces engageable with said body to prevent substantial movement in a plane at right angles to the insertion direction of said slot, and said recess further includes control surfaces engageable with said resilient member to prevent substantial movement in a direction along said slot.

Such a connector retains the body of the terminal within the chamber against lateral and outward movement, whilst permitting the resilient contact to protrude into the slot. The control surfaces prevent lateral movement of the resilient contact, thus maintaining a perpendicular contact with terminals of a card-edge.

Preferably the internal walls of the chamber substantially follow the external shape of the terminal so as to provide abutment surfaces. The control surfaces are preferably provided by the sides of the opening between the recess and slot.

According to a second aspect, the invention provides a housing for a card-edge connector, the housing having a slot to receive a card-edge, and a recess at the side of said slot to receive an electrical terminal, wherein said recess has an opening into said slot and through which said terminal protrudes in use, said recess further including a plurality of abutment surfaces engageable with said terminal to prevent substantial movement of said terminal in a plane at right angles to the insertion direction of said slot, and said recess further includes control surfaces adjacent said slot and engageable with said terminal to prevent substantial movement of said terminal along said slot in use.

According to a third aspect, the invention provides an electrical terminal for a card-edge connector, said terminal being of sheet metal and comprising a base, a resilient arm extending from the base and bent over the base to lie at a spacing therefrom, and upstanding side arms on either side of said resilient arm, said side arms extending beyond the bend and free end of said resilient arm, and having free end portions bent towards the respective other side arm to define a substantially continuous peripheral wall around said resilient arm, and said resilient arm extending outwardly of said wall to define an electrical contact.

Preferably a mid-portion of at least one of said walls is bent inwardly to lie behind said resilient arm and thereby prevent excessive inward movement of said arm with respect to said wall.

Such terminals are less likely to become damaged by entanglement because the peripheral wall protects the resilient arm. Furthermore the wall projects the resilient arm from side loads of the connector housing in use. The terminal is preferably folded from a sheet metal blank.

BRIEF DESCRIPTION OF THE DRAWINGS

Other aspects of the invention will be apparent from the following description of a preferred embodiment shown by way of example only in the accompanying drawings in which.

DESCRIPTION OF A PREFERRED EMBODIMENT

Figure 1:
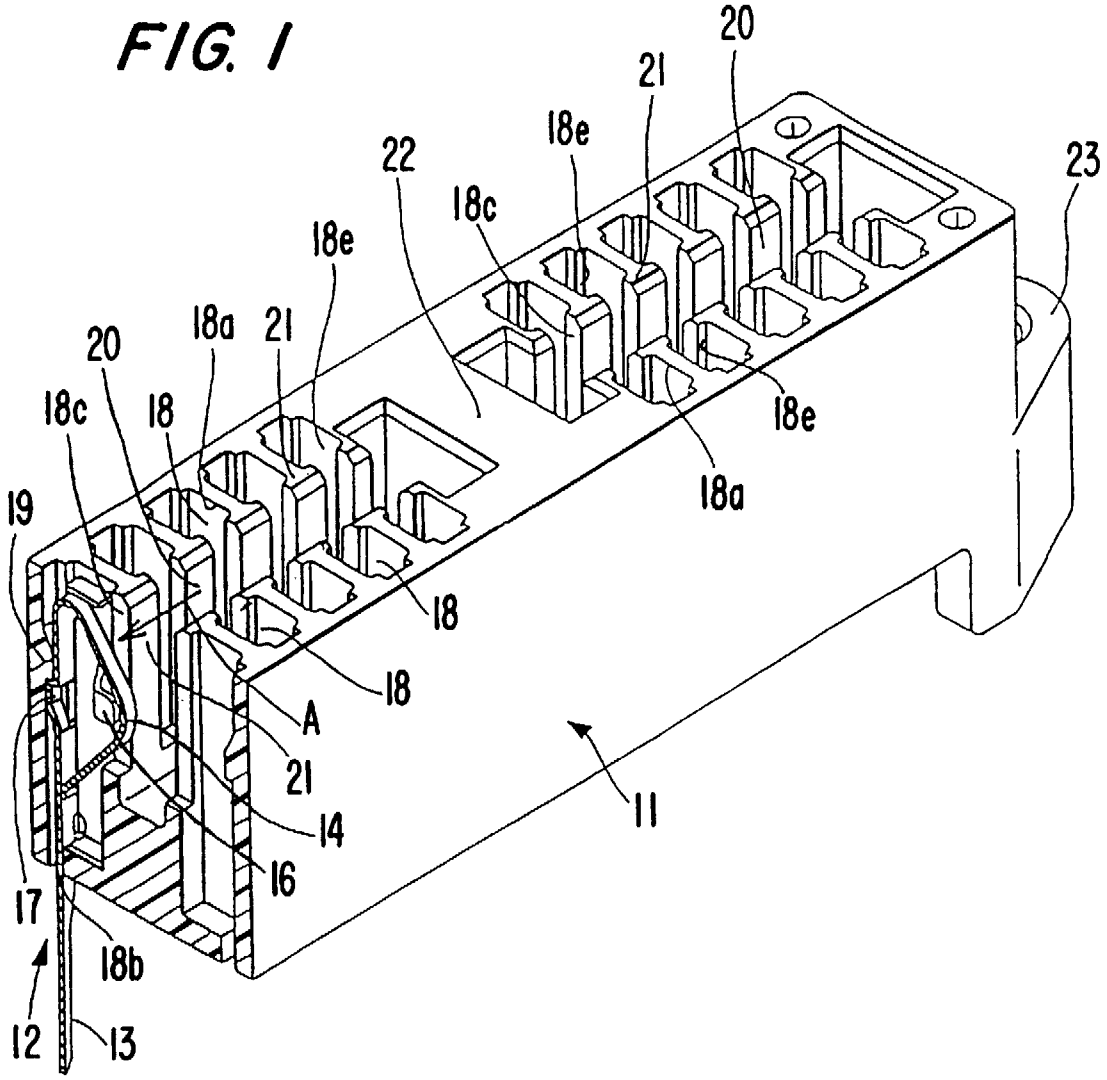
FIG. 1 is a partially cut away diagonal view of the card-edge connector of the invention.

The card-edge connector of the present embodiment is for attachment to a base plate, and serves to connect the base plate to printed circuit card or board. As shown in FIG. 1, the card-edge connector comprises a connector housing 11 and contact terminal 12 (one only illustrated) assembled into the housing 11.

Figure 3:
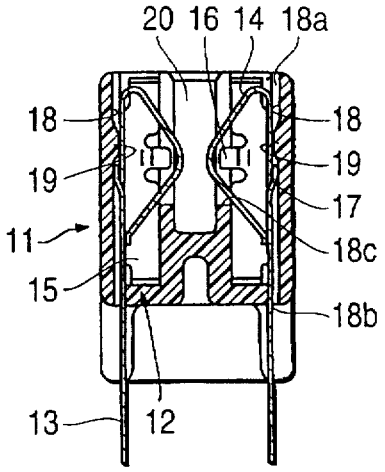
FIG. 3 is a cross-section through the connector of FIG. 1.
Figure 4:
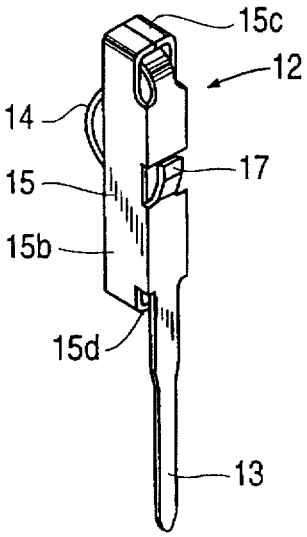
FIG. 4 is a diagonal view showing a resilient contact terminal.
Figure 5:
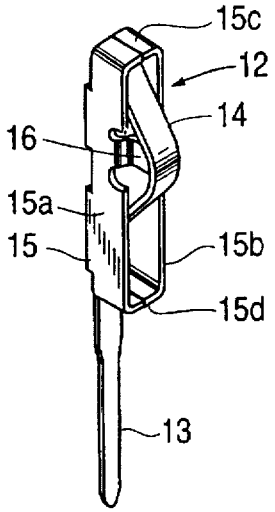
FIG. 5 is a diagonal view corresponding to FIG. 4 but from the other side.

As shown in FIGS. 3 to 5, the terminal 12 is formed by bending a thin metal plate into a box shape. A lower portion of the terminal 12 has an attachment arm 13 which is inserted into an attachment hole formed on a base plate (not shown) and is soldered therein. Other conventional kinds of connection are possible. An upper portion of the contact terminal 12 has an resilient contact 14 formed by folding over the metal plate into a bow shape. A left side wall 15*a* and a right side wall 15*b* are formed so as to shield the contact 14. The upper and lower ends of the side walls 15*a* and 15*b* are bent inwards to form upper and lower end walls 15*c* and 15*d*. Accordingly, the walls 15 surround the base portion, including the folded over portion of the resilient contact 14 which projects forwards.

The inner side of the contact 14 (within the side walls 15) has a stopper 16 which prevents excessive bending of the contact 14. In other words, although during the normal insertion operation of a base plate 2, the contact 14 does not make contact with the stopper 16, in the case where a large force is applied to the contact 14 by the edge of the base plate 2 or the like, the contact 14 is arranged to abut the stopper 16. This stopper 16 is formed by bending the central portion of the left and right side faces 15*a* and 15*b* inwards and then outwards, as illustrated, to provide an abutment immediately behind the contact 14 (FIG. 3).

The rear face of the terminal 12 (FIG. 4) has a stopping member 17 formed by cutting away in an outward direction an upper part thereof. When the contact terminal 12 is inserted into a terminal insertion chamber 18, to be described later, the stopping member 17 fits with a fitting member 19 formed on an inner wall face of the terminal insertion chamber 18, thereby fixing the contact terminal 12 in place.

Figure 6:
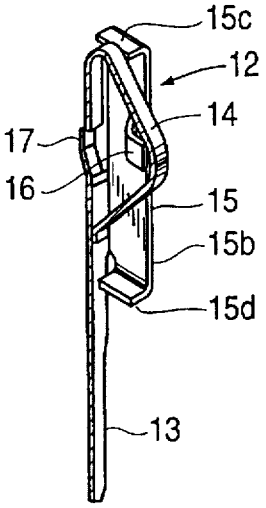
FIG. 6 is a partially cut away diagonal view of the contact terminal.

As shown in FIG. 1, the connector housing 11 (made of a synthetic resin) forms a long and narrow rectangular solid. Its upper face has a slot 20 which allows the insertion of an edge of a plate 2 (see FIG. 6). The inner wall faces of the slot 20 have a plurality of terminal insertion chambers 18 which are concave in shape, face each other and are arranged to be mutually parallel and equidistant along the lengthwise direction of the connector housing 11. The size of each chamber 18 is approximately equal to that of a contact terminal 12. The upper face of each chamber 18 opens out and forms a mouth 18a through which the contact terminal 12 is inserted. A through hole 18*b* is formed on a lower face to permit passage of the attachment arm 13. Each chamber 18 has opposed walls 18*e* which retain the terminal 12.

As shown in FIG. 3, the fitting member 19 is formed in a uniform manner approximately in the centre on an inner wall of the terminal insertion chamber 18. The fitting member 19 engages stopping member 17 as the terminal is inserted. The open side of the chamber 18 forms an exit mouth 18*c* for allowing the contact 14 to project into the slot 20. When the edge of the plate 2 is inserted into the slot 20, each projecting contact 14 makes pressure contact with conducting members 6 (see FIG. 8) provided on both side faces of the plate 2.

The exit mouth 18*c* has controlling walls 21 formed by extending the side edges in the direction of the slot. These side edges are close to the contact 14, and can restrain the terminal 12 in the chamber 18 whilst also preventing excessive sideways movement of the contact 14, as indicated by arrow D of FIG. 2.

The slot 20 is divided into two by means of a partitioning wall 22 provided approximately in the centre thereof. The edge of the plate 2 is arranged to be inserted into the insertion member 20 so as to straddle the partitioning wall 22; alternatively the partitioning wall 22 may be omitted. Both ends of the connector housing 11 have attachment members 23 projecting therefrom, the connector housing 11 being fixed to the base by means of screws.

Operation of the embodiment is as follows. The contact terminal 12 is inserted, attachment arm 13 first, into the terminal insertion chamber 18 via the mouth 18*a*. The stopping member 17 is engaged by the fitting member 19, thereby holding the contact terminal 12 in an unremovable state.

Figure 2:
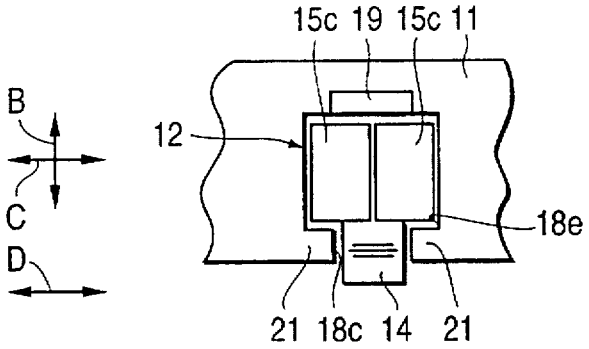
FIG. 2 is a plan view showing part of the connector of FIG. 1 from above.

When the contact terminal 12 is being transported on a parts feeder, there is a possibility of two contact terminals 12 making contact with each other. However, in the present embodiment, since the side walls 15 are provided so as to enclose the base portion of the contact 14, even if the contact terminals 12 make contact with each other, they do not get entangled. As a result, the contact 14 is prevented from being forcibly distorted. Moreover, during the assembly operation, there is also a possibility of the terminal 12 accidentally making contact with the side face or the like of the connector housing 11. However, in the present embodiment, since the base portion of the contact 14 is shielded by the side walls 15, the root of the contact 14 cannot make direct contact with the side face or the like of the connector housing 11, thereby preventing distortion of the contact 14. As illustrated in FIG. 2, the internal walls of the chamber 18 prevent any substantial movement of the terminal in the direction indicated by arrows B and C.

When the contact terminal 12 is inserted, the contact 14 projects via the exit mouth 18*c*. As the plate 2 is inserted into the slot 20, the respective contacts 14 make pressure contact with the corresponding conducting members 6. When the plate 2 is inserted or removed, there is a possibility of external pressure being applied on the contact 14 in a direction other than the correct bending direction. For example, due to the edge of the plate 2, a force in the direction of arrow A in FIG. 1 can be applied. The controlling wall 21 resists the change of shape by providing side support to the resilient contact 14. Thus, superior functionality with respect to maintenance of shape is achieved and a stable and good contact state is established with respect to the base plate 2.

Moreover, when the plate 2 is inserted, there is also a possibility of a large force being applied on the elastic contact 14 in the correct (inwards) bending direction, for example due to tilting of the plate 2. However, since the stopper 16 is provided on the contact terminal 12, the elastic contact 14 makes contact with the stopper 16 if it bends more than the normal amount. As a result, bending of the elastic contact 14 beyond the normal amount is prevented.

Figure 7:
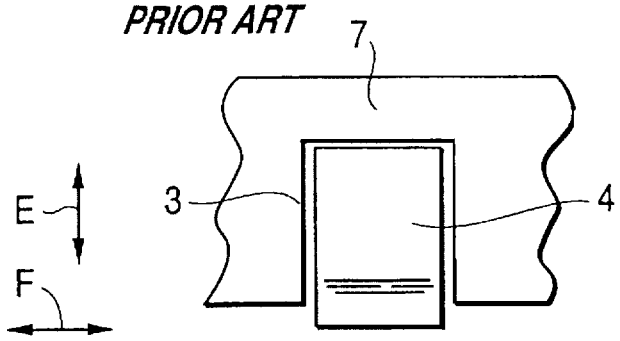
FIG. 7 PRIOR ART
FIG. 7 is a plan view showing part of a prior art cardedge connector from above.
Figure 8:
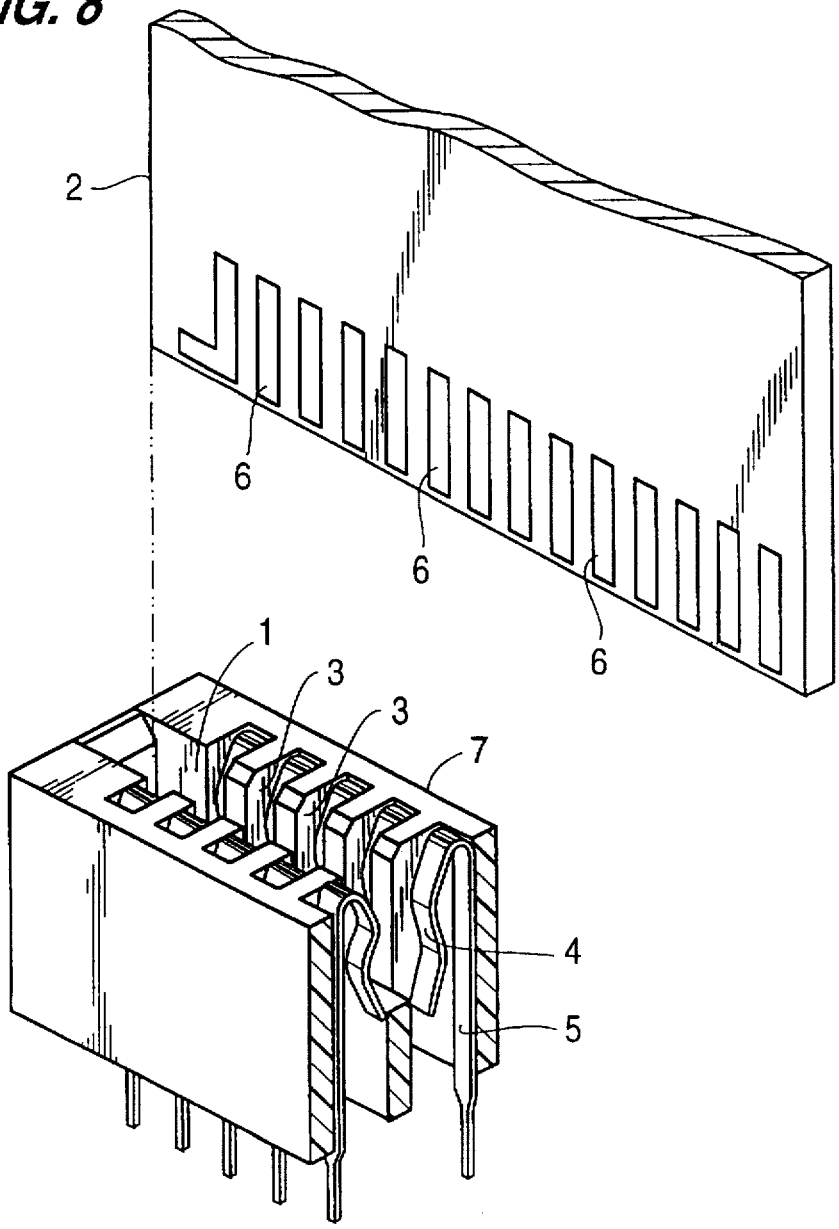
FIG. 8 is a partially cut away diagonal view of a prior art card-edge connector.

As illustrated in FIGS. 7 and 8 excessive inward movement of the contact face of the resilient arm 4 is not prevented. Furthermore the terminal is not restrained in the direction indicated by arrow E, nor is the resilient arm itself protected from sideways bending forces in the direction of arrow F.

The present invention is not limited to the above embodiment and for example, the following variations can be embodied within the technical scope of the present invention.

In the above embodiment, although the side walls 15 are arranged to enclose the entire base portion of the elastic contact 14, it may equally be arranged so that the base portion is not entirely but only partly enclosed to the extent that the enclosure prevents entanglement of the elastic contacts if they make contact with each other.

Moreover, the present invention may be embodied in various ways other than those described above without deviating from the scope of the appended claims.

I claim:

1. A card-edge connector comprising a housing having a slot to receive a card-edge, the housing having a recess at the side of said slot, said recess having an electrical terminal therein and an open end through which said terminal is inserted into said recess, the terminal comprising a body within said recess and a resilient member protruding into said slot through an opening for contact with a card-edge, wherein said opening extends to and is open at said open end of said recess, said recess includes a plurality of abutment surfaces engageable with said body to prevent substantial movement toward and away from said slot and control surfaces at the open end and along the length of said opening engageable with said resilient member to prevent substantial movement in a direction along said slot, said terminal is composed of sheet metal and comprises a base, a resilient arm extending from the base and bent over the base to lie at a spacing therefrom, and upstanding side arms on either side of said resilient arm, said side arms extending beyond the bend and free end of said resilient arm and having free end portions bent towards the respective other side arm to define a substantially continuous peripheral wall around said resilient arm, said resilient arm extending outwardly of said wall to define an electrical contact, and wherein a mid portion of at least one of said walls of said terminal is bent inwardly to lie behind said resilient arm and thereby prevent excessive inward movement of said arm with respect to said wall.

2. A connector according to claim 1 wherein said abutment surfaces comprise internal walls of said recess.

3. A connector according to claim 2 wherein said recess is substantially rectangular, the opening to said slot being provided in one wall of said recess.

4. A connector according to claim 3 wherein said opening is at the mid point of said one wall.

5. A connector according to claim 4 wherein said recess is substantially square.

6. A connector according to claim 3 wherein said control surfaces are constituted by opposite edges of said opening.

7. A connector according to claim 1 wherein said resilient member comprises an arm of said terminal, said arm extending inwardly and downwardly of said slot.

8. A connector according to claim 7 wherein the free end of said arm extends inwardly of said recess.

9. A connector according to claim 1 and having more than one recess and terminal along one side of said slot.

10. A connector according to claim 9 and having more than one recess and terminal along both sides of said slot.

11. A connector according to claim 1 wherein each of said side arms of said terminal has free end portions bent symmetrically towards each other.

12. A connector according to claim 1 wherein said recess includes a fitting member, and said terminal includes a stopping member which engages the fitting member to prevent substantial movement of the terminal toward the open end of the recess.

* * * * *